US006394776B2

(12) United States Patent
Boldenow

(10) Patent No.: US 6,394,776 B2
(45) Date of Patent: May 28, 2002

(54) DOUBLE ROTOR-VANE PUMP

(76) Inventor: David Allan Boldenow, 5302 Localizer Ct., Granbury, TX (US) 76049

( * ) Notice: Subject to any disclaimer, the term of this patent is extended or adjusted under 35 U.S.C. 154(b) by 0 days.

(21) Appl. No.: 09/760,993

(22) Filed: Jan. 16, 2001

Related U.S. Application Data

(60) Provisional application No. 60/176,794, filed on Jan. 18, 2000.

(51) Int. Cl.[7] ..... F01C 21/00

(52) U.S. Cl. ..... 418/69; 418/212; 417/295

(58) Field of Search ..... 418/69, 212; 417/295

(56) References Cited

U.S. PATENT DOCUMENTS

| | | | | | |
|---|---|---|---|---|---|
| 2,369,019 | A | * | 2/1945 | Chisholm | 418/212 |
| 2,666,394 | A | * | 1/1954 | Sadler et al. | 418/69 |
| 3,008,426 | A | * | 11/1961 | Edwards et al. | 418/69 |
| 3,105,441 | A | * | 10/1963 | Grille et al. | 418/69 |
| 3,433,166 | A | * | 3/1969 | Birkemeier | 418/69 |
| 4,415,319 | A | * | 11/1983 | Masuda et al. | 418/212 |
| 4,543,939 | A | * | 10/1985 | Ehrhart et al. | 123/533 |
| 4,621,982 | A | * | 11/1986 | Schulz et al. | 417/201 |
| 4,826,407 | A | * | 5/1989 | Poole | 418/15 |
| 5,152,672 | A | * | 10/1992 | Miyazawa | 417/63 |
| 6,086,347 | A | * | 7/2000 | Ryska et al. | 418/212 |

FOREIGN PATENT DOCUMENTS

| | | | | |
|---|---|---|---|---|
| JP | 59-029788 | * | 2/1984 | 418/212 |
| JP | 59-063392 | * | 4/1984 | 418/69 |
| JP | 59-070895 | * | 4/1984 | 418/2 |
| JP | 4110392 | * | 10/1991 | 417/310 |
| JP | 04-214992 | * | 8/1992 | 418/2 |

* cited by examiner

*Primary Examiner*—Thomas Denion
*Assistant Examiner*—Theresa Trieu

(57) ABSTRACT

Two rotary vane pumps driven by a common drive shaft with each pump sharing a common intake. Each pump's rotor is connected to the drive shaft by shear means. A valve is utilized to seal off a failed pump, and to protect the operating pump from foreign objects created by the failed pump. If either rotary vane pump fails its shear means, the other pump continues to operate unaffected, and maintains nominal pump performance.

19 Claims, 5 Drawing Sheets

SECTION III-III

SECTION I-I

SECTION II-II

SECTION III-III

DOUBLE ROTOR-VANE PUMP

This application claims benefit of Ser. No. 60/176,794 filed Jan. 18, 2000.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to double pumps, which are driven by way of a common shaft, and in particular to double rotor vane pumps.

A double pump similar to this invention is known from U.S. Pat. No. 4,621,982 which utilized a rotary vane pump in conjunction with a radial piston pump. The double pump identified in U.S. Pat. No. 4,621,982 is only designed for failures of the radial piston pump and not for failures of the rotary vane pump. The double pump identified in U.S. Pat. No. 4,621,982 also relies on cam rings for operation, which add complexity and cost.

BRIEF SUMMARY OF THE INVENTION

It is therefore an objective of this invention to overcome the disadvantages of the previous art through part reduction and simplification, and to provide a double rotor vane pump where either pump can fail while the remaining operating pump can maintain nominal pump performance.

Prior art has been insufficient in reliability to meet the needs of single engine aircraft, most of which employ a rotary vane pump to power critical attitude and navigation instruments. This invention used in said application will greatly increase safety of flight.

To obtain the desired result of reduced complexity and to expanded the failure modes to include either pump results in: a double rotor pump with both rotors being driven by shear means with designed in failure locations.

Each rotor of the double rotor vane pump is powered from a common drive shaft. Each rotor of the double rotor vane pump has the capability to fail its shearing device while having no effect on the other rotor of the pump.

Although many methods are possible, the simplest method envisioned by the inventor for allowing each rotor to fail independent of the other rotor is to incorporate a key area into the inner diameter of the rotor as a designed in shear failure point. Another method for allowing each rotor to fail independent of the other rotor is the use of shear pins at each rotor.

The double rotor vane pump design utilizes two rotors each housed in its own individual chamber. Each rotor/chamber is located along a common axis of rotation. Both chambers of the double rotor vane pump share a common intake. Reed valves or a shuttle valve are used to isolate a pump and protect it from contamination by residue from a failed pump.

The double rotor vane pump uses a drive shaft, which has a torsional shear load failure value, which is high enough to allow the shear means to fail at each rotor without failing the shaft. The double rotor vane pump's drive shaft is also designed such that in the event of a drive shaft seizure, the drive shaft's torsional shear load failure value will be low enough to not cause any damage to the double rotor vane pump's drive source.

DETAILED DESCRIPTION OF THE INVENTION

Figure 1:
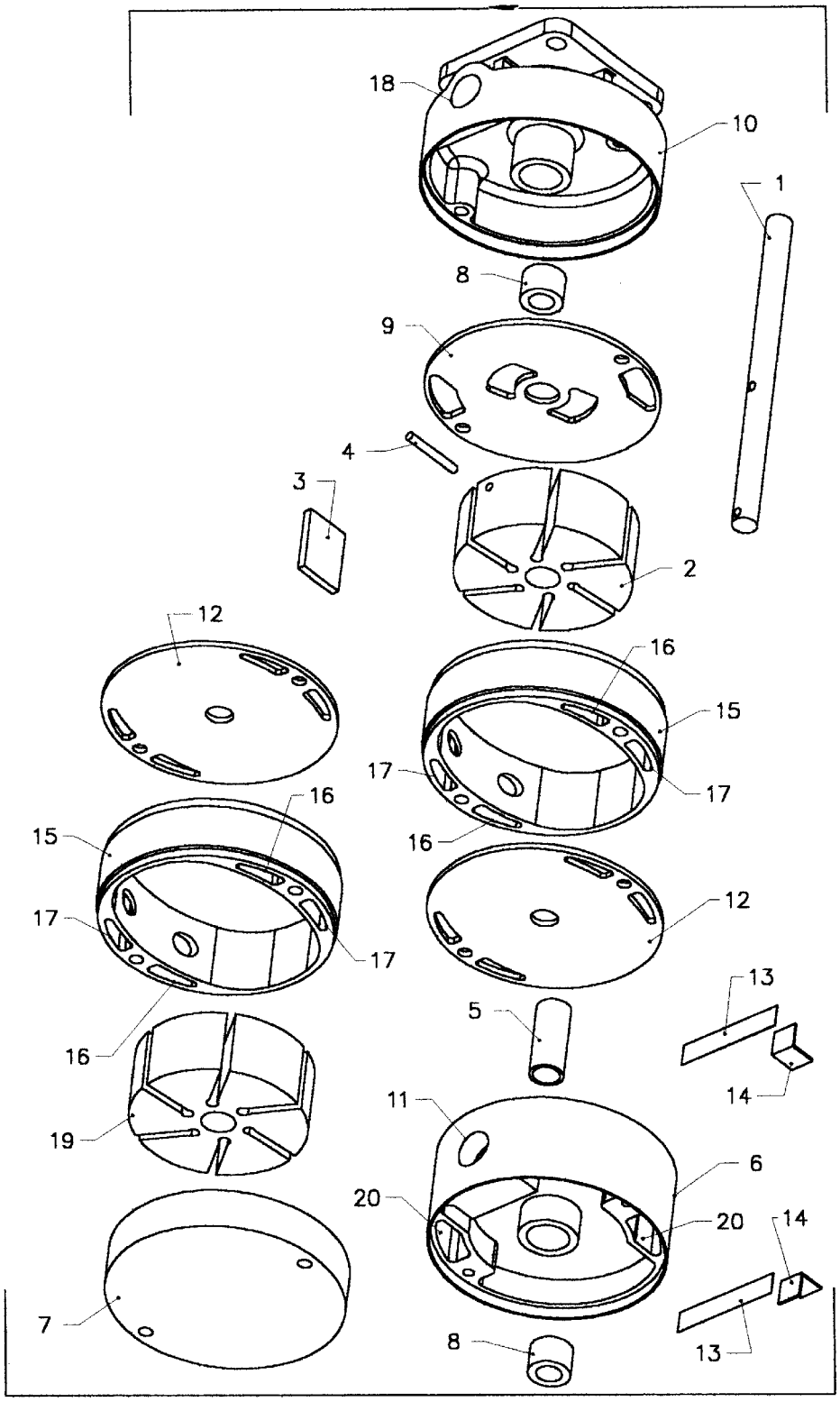
FIG. 1 is an exploded isometric view of the double rotor vane pump.
Figure 2:
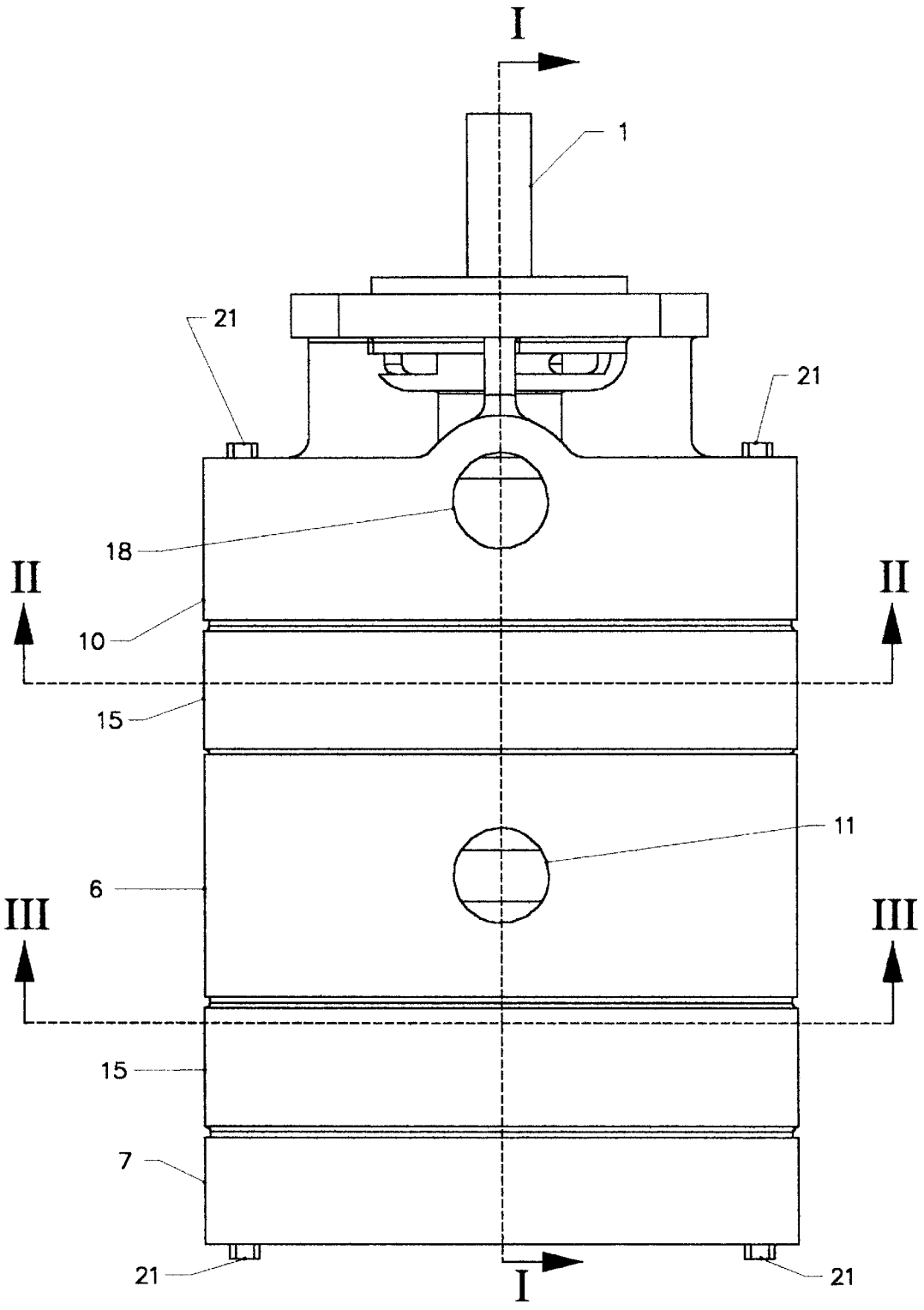
FIG. 2 is a plan view of the double rotor vane pump assembly.
Figure 3:
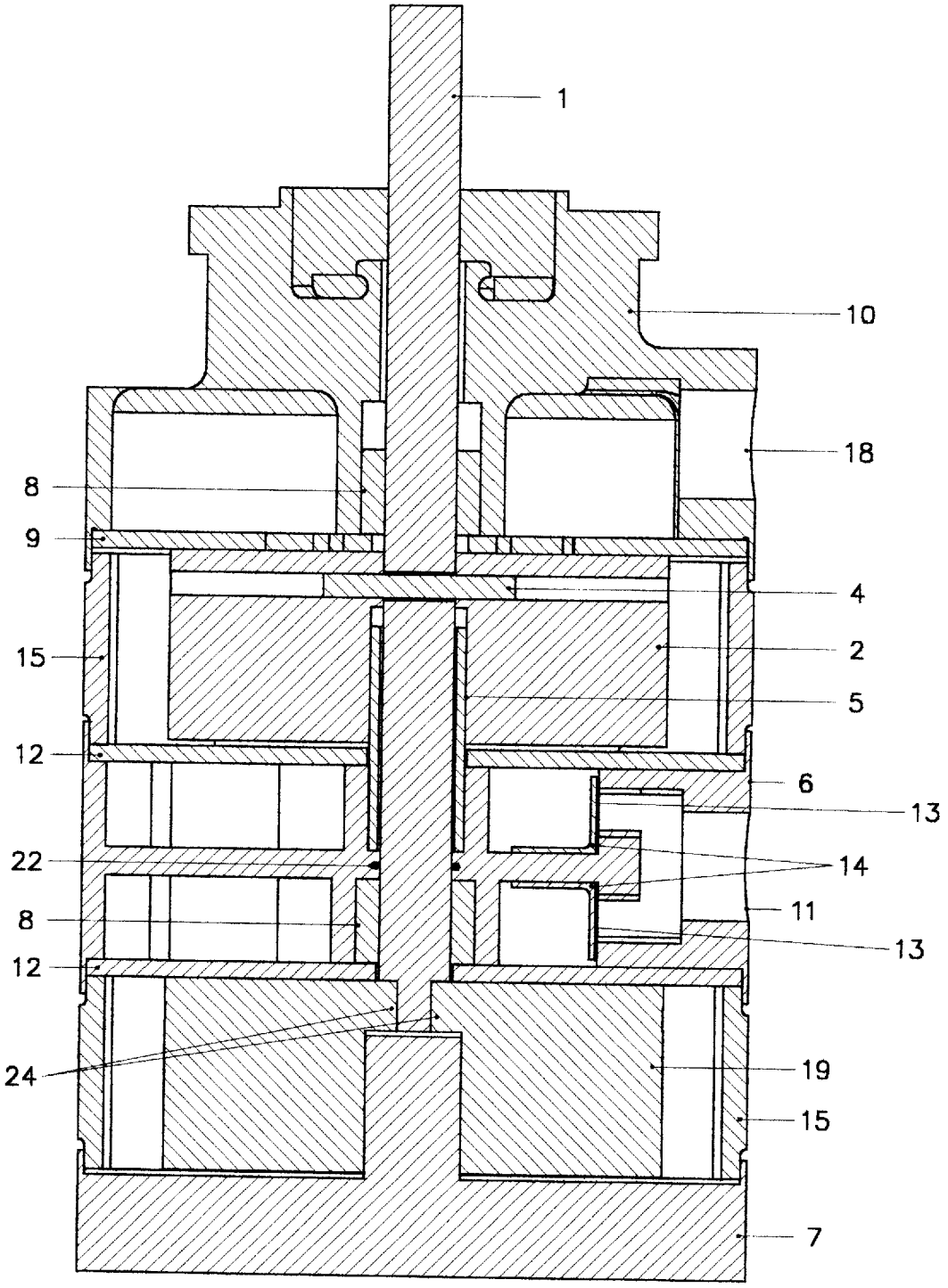
FIG. 3 is a section cut through the double rotor vane pump assembly.
Figure 4:
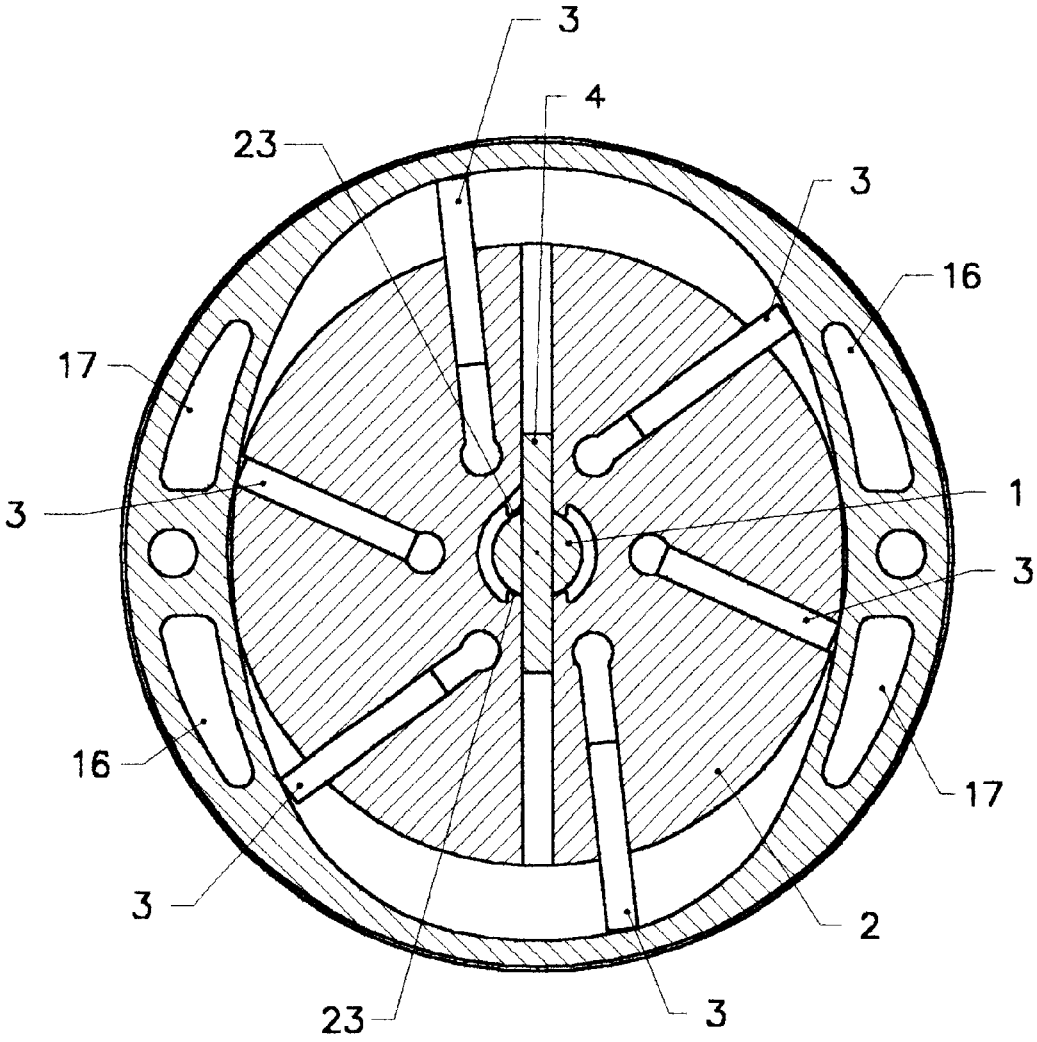
FIG. 4 is a section cut through the forward pump, rotor, drive shaft and shear pin.
Figure 5:
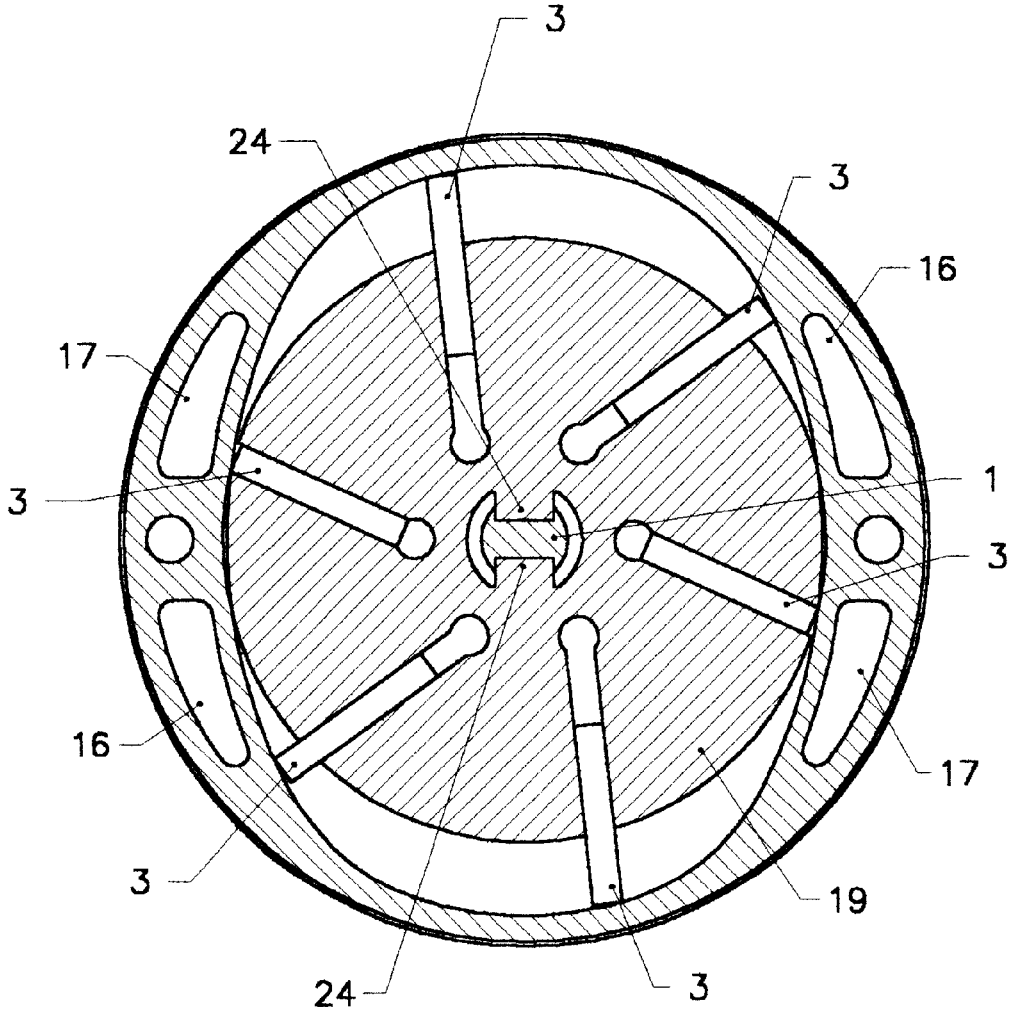
FIG. 5 is a section cut through the rear pump, keyed rotor area and drive shaft.

The double-rotor vane-pump is comprised of two independent sections, each a rotary vane-pump, constructed along a common axis. A single drive-shaft (1) is used to drive the rotors (2)(19) of both pump sections and their associated vanes (3) by a shear-pin (4) which is press-fit into a transverse hole in the forward rotor (2), or by shear keys (24) which are integral to the rear rotor (19). The forward section's rotor (2) rotates upon a forward bearing (5) which is press-fit into the intake manifold (6). The drive-shaft (1) passes through said forward bearing (5) to the rear section. The rear section's rotor (19) rotates on a bearing integral to the rear-plate (7).

Said shear keys (24) and shear-pin (4) are designed to independently shear when the resistance to rotation of a rotor increases significantly from the normal operating resistance to rotation. This increase in resistance to rotation may be caused by breakage of a vane due to ingestion of contamination into a pump chamber, or to normal wear of the affected vane.

A major improvement of this design over prior art is that one of the two sections of this double-rotor vane-pump continues to operate after failure of the other, and this redundant operation is achieved without the incorporation of complex mechanisms such as cam-rings.

The drive-shaft (1) is housed in and supported by two bearings (8), one located in the forward exhaust manifold (10) and the other in the intake manifold housing (6). Air is drawn in through the opening (11) in the intake manifold housing and distributed to each section. Before entering the intake area of the intake manifold housing, located between the manifold plates (12), air passes a reed-valve (13), which is attached to the intake manifold by a bracket (14). These reed valves (13) allow flow into each section while preventing reverse flow following the failure of a section. The intake air is then drawn into both rotor housings (15), each of which has two intake ports (16). The rotors (2)(19) and their associated vanes (3) compress the air in the elliptically shaped interior of the rotor housings. After compression, the air is expelled through exhaust ports (17) in each rotor housing (15). This compressed air passes through the outermost cutouts in the manifold plates (12) and into all of the exhaust plate's (9) cutouts. In this manner, the exhaust from the rear section passes through ports (20) in the intake manifold housing, and then is combined with the exhaust from the front section. The compressed air then passes out through the exhaust exit (18). Four bolts (21) are used to assemble the double-rotor vane-pump.

Two methods of attaching the rotors (2)(19) to the double rotor vane pump's drive shaft (1) are shown. Both methods incorporate safety shear means in case of a pump failure. Both methods of attaching the double rotor vane pump's rotors (2)(19) to the drive-shaft (1) are simpler than the prior art, and can be used at either rotor location.

The forward rotor (2) of the double rotor vane pump is constructed so that the rotor's inner diameter at the shear-pin location is only slightly larger than that of the drive-shaft, and smaller than the remainder of the inner diameter of the forward rotor. This raised lobe area (23) integral to the forward rotor (2), and located at the point where the shear-pin (4) is pressed into the rotor, acts to induce pure shear to the shear-pin (4). Maintaining the shear-location of the shear-pin (4) at a point where the diameter of the forward rotor (2) and that of the drive-shaft (1) are nearly identical will cause the shear-pin (4) to shear cleanly with little bending, minimizing distortion to the shear-pin (4). The fragments of the shear-pin (4) will relieve most of their interference as the sheared ends of the shear-pin (4) impact each other on subsequent rotations. This event happens very quickly, minimizing heat from impacting blows.

In addition, the detailed description utilizes a material for construction of the forward rotor (2), such as carbon, that is softer than the material of the shear-pin (4). This allows fragments of a shear-pin (4) to easily remove material from the forward rotor (2), providing clearance between the forward rotor (2) and the section of the shear-pin (4) still in the drive-shaft (1) and, therefore, reducing friction between the drive shaft (1) and the failed forward rotor (2).

The detailed description of the double-rotor vane-pump includes constructing the rear rotor (19) such that rear rotor's inner diameter incorporates a key (24) which interfaces with a matching keyway feature on the drive-shaft (1). These keys (24) between the rear rotor (19) and the drive-shaft (1) act as the safety shear means for the rear pump section. Again, the detailed description utilizes a material for construction of the rear rotor (19), such as carbon, that is softer than the material of the drive-shaft (1). This allows the drive-shaft (1) to easily remove material from the rear rotor (19), providing clearance between the rear rotor (19) and the drive-shaft (1) and, therefore, reducing friction between the drive shaft (1) and the failed rear rotor (19).

In the detailed description a seal (22) on the drive-shaft may be used, along with the reed-valves (13), to prevent airflow between a failed section and an operating section.

Also, in the detailed description, the drive-shaft (1) is designed in such a manner that in the unlikely event of a drive-shaft seizure, it will shear with no damage to the drive source (typically the aircraft engine).

In the detailed description, a vacuum or pressure switch may be used to monitor each section of the double-rotor vane-pump. Said switches may be used to drive indicators which show the operational status of each section. Said indicators may provide prompt notification of the failure of one section of the double-rotor vane-pump, allowing the operator to have the pump repaired or replaced before the failure of the remaining, operational, section.

The presented invention is ideally suited for use on single-engine aircraft, most of which utilize a rotary-vane pump to power gyroscopic instruments. The double-rotor vane-pump provides an improvement in safety of these aircraft.

I claim:

1. A vane-type pump which does not use cam rings, intended for the pumping of gaseous substances which incorporates two independent pumping chambers, each incorporating a rotor and vanes; both rotors being coupled to a single driving shaft wherein both of these rotors have coupling means to the driving shaft such that an increase in opposition to rotation by one of said rotors beyond a predetermined limit will cause one of said rotors to be disconnected from the driving shaft and allow the other pumping chamber to continue to pump without degradation to the functional chamber's pumping capability.

2. The pump of claim 1 in which at least one of the rotors is coupled to the drive-shaft by an area of matching features between the rotor and the drive shaft.

3. The pump of claim 1 in which at least one of the rotors is coupled to the drive-shaft by a shear-pin.

4. The pump of claim 3 wherein said rotor's said inner surface is of a radius at its inner transverse bore of nearly equivalent radius to said drive-shaft's local outer radius.

5. The pump of claim 3 wherein said shear pin has a desired fracture location between said drive-shaft and said first rotor.

6. The pump of claim 1 in which at least one of the rotors is coupled to the drive-shaft by a shear-key.

7. The pump of claim 6 wherein said rotor's said inner surface is of a radius at its inner transverse bore of nearly equivalent radius to said drive-shaft's local outer radius.

8. The pump of claim 6 wherein said shear-key has a desired fracture location between said drive-shaft and said first rotor.

9. The pump of claim 1 in which a common intake is provided for both chambers and a valve or valves are incorporated to restrict the flow through each chamber.

10. A double pump including a first rotary pump, a second rotary pump, a drive-shaft for driving both said first and second rotary pumps and defining a rotational axis, a first rotor for said first pump driven by said drive shaft by an area of matching features between said first rotor and said drive shaft, a second rotor for said second pump driven by said drive shaft by an area of matching features between said second rotor and said drive shaft, an intake common to said first and second rotary pumps, means to allow one of said pumps to fail, a valve or vales to restrict flow through said pump that has failed, where the position of said valve or valves is determined by the operational condition of said pump that has failed.

11. The double pump set forth in claim 10 where said first rotor's matching features with said drive shaft act as safety shear means.

12. The double pump set forth in claim 10 where said second rotor's matching features with said drive shaft act as safety shear means.

13. The double pump set forth in claim 10 where said first rotor's safety shear means features have a desired fracture location between said drive-shaft and said first rotor.

14. The double pump set forth in claim 10 where said second rotor's safety shear means features have a desired fracture location between said drive-shaft and said second rotor.

15. A double pump including a first rotary pump, a second rotary pump, a drive-shaft for driving both said first and second rotary pumps and defining a rotational axis, a first rotor for said first pump driven by said drive shaft by a shear-pin or shear-key between said first rotor and said drive shaft, a second rotor for said second pump driven by said drive shaft by a shear-pin or shear-key between said second rotor and said drive shaft, an intake common to said first and second rotary pumps, means to allow one of said pumps to fail, a valve or vales to restrict flow through said pump that has failed, where the position of said valve or valves is determined by the operational condition of said pump that has failed.

16. The double pump set forth in claim 15 where said first rotor's shear-pin or key act as safety shear means.

17. The double pump set forth in claim 15 where said second rotor's shear-pin or shear-key act as safety shear means.

18. The double pump set forth in claim 15 where said first rotor's safety shear means features have a desired fracture location between said drive-shaft and said first rotor.

19. The double pump set forth in claim 15 where said second rotor's safety shear means features have a desired fracture location between said drive-shaft and said second rotor.

* * * * *